United States Patent [19]

Sample

[11] 4,432,527

[45] Feb. 21, 1984

[54] TROLLING MOTOR BRACKET

[76] Inventor: Frank C. Sample, Rte. 2, Box 286B, West Monroe, La. 71291

[21] Appl. No.: 354,967

[22] Filed: Mar. 5, 1982

[51] Int. Cl.[3] ..... F16M 13/00

[52] U.S. Cl. ..... 248/548; 248/640; 248/642

[58] Field of Search ..... 248/640, 641, 642, 643, 248/548; 440/900

[56] References Cited

U.S. PATENT DOCUMENTS

| | | | |
|---|---|---|---|
| 650,558 | 5/1900 | Hatch | 248/640 X |
| 2,044,920 | 6/1936 | Smith | 248/642 X |
| 2,954,950 | 10/1960 | Hart | 248/642 |
| 2,996,273 | 8/1961 | Bandli | 248/642 |
| 3,139,062 | 6/1964 | Keefe | 248/642 X |
| 3,240,453 | 3/1966 | Kiekhaefer | 248/642 X |
| 3,948,204 | 4/1976 | Brock | 248/642 X |
| 4,008,680 | 2/1977 | Alexander | 248/642 X |
| 4,175,724 | 11/1979 | Bauman | 248/642 |
| 4,306,703 | 12/1981 | Finze | 248/642 |

*Primary Examiner*—J. Franklin Foss
*Attorney, Agent, or Firm*—John M. Harrison

[57] ABSTRACT

A trolling motor bracket having a pivoting "breakaway" feature to protect the shaft of a trolling motor, and a shaft rotating feature, which bracket is characterized by a shaft bracket having a split housing and designed to adjustably receive the trolling motor shaft; a bracket hinge pivotally attached to the shaft bracket, and breakaway pins for friction engagement with a cooperating slot in the shaft bracket to facilitate downward pivoting of the shaft bracket and trolling motor with respect to the bracket hinge when the trolling motor encounters an underwater obstacle; and a support bracket mounted on a conventional trolling motor lift bracket attached to the boat, and attached to the bracket hinge. The trolling motor can be pivotally adjusted with respect to the bow of the boat by operation of the bracket hinge, and the pressure required to effect downward pivoting of the shaft bracket and trolling motor shaft on the bracket hinge can be controlled by adjusting the breakaway pins. In a preferred embodiment of the invention a specially designed insert is provided in the shaft bracket to effect a positive and adjustable engagement of the trolling motor shaft by the shaft bracket.

5 Claims, 11 Drawing Figures

TROLLING MOTOR BRACKET

BACKGROUND OF THE INVENTION

1. Field of the Invention

This invention relates to electric trolling motors for boats, and more particularly, to a rotatably adjustable, "breakaway" bracket for trolling motors which includes a shaft bracket for carrying the shaft of the trolling motor; a bracket hinge which pivotally cooperates with the shaft bracket by friction engagement to facilitate downward rotation of the shaft and shaft bracket with respect to the bracket hinge when the shaft or submerged motor strikes an underwater obstacle, and a support bracket carried by the bracket hinge and mounted on the conventional trolling motor lift bracket attached to a boat. A primary feature of the trolling motor bracket is the "breakaway" function, which operates to prevent damage to the trolling motor shaft when the shaft or trolling motor strikes an underwater obstacle during normal operation. This breakaway feature is facilitated by a breakaway pin slot provided in the shaft bracket and at least one breakaway pin threaded in the bracket hinge in normal registration with the pin slot to permit application of a selected amount of pressure on the shaft bracket and control the pressure required to pivot the shaft bracket and shaft on the pivot pin. Another primary feature of the trolling motor bracket is the provision of rotation of the motor shaft with respect to the bow of the boat by means of the bracket hinge in order to compensate for substantially any type of trolling motor mount on the boat. Furthermore, the bracket can be mounted on substantially any conventional motor lift bracket. A specially designed insert can be used in cooperation with a preferred shaft bracket having a split housing in order to more positively engage, secure and adjust the trolling motor shaft in the shaft bracket, and to accommodate motor shafts of varying diameter.

2. Description of the Prior Art

Various types of brackets are known in the art for mounting motors to boats. Typical of these devices is the "Outboard Motor Bracket" disclosed in U.S. Pat. No. 2,264,364, to W. C. Conover. This bracket includes a vertically-oriented bracket member having a curved top portion attached to a motor and a clamp mechanism hinged to the bracket member for pivotally securing the motor to the transom of a boat. The motor can thus be pivotally raised from the water and locked into position, and allowed to pivot downwardly into the water, in functional position, as desired. Another motor bracket is disclosed in U.S. Pat. No. 4,094,482, to L. C. Weaver, and includes a mount having a base bracket for mounting the motor shaft of a trolling motor on a boat deck and swinging the shaft between a vertical operating position and a horizontal position over the deck. A clamping yoke for holding the motor shaft is swiveled on the bracket and a manually releasable latch which is pivoted on the bracket, selectively locks the clamping yoke in the respective operating and upward-pivoted positions when the yoke is swung to either position. A Trolling Motor Safety Mount for a trolling motor is included in U.S. Pat. No. 4,019,703 to Robert W. Meredith, which apparatus includes a clamp for attachment to the stern of a boat, a hollow mounting block pivotally mounted to the clamp, a detent device for maintaining the block in abutment with the clamp, and a latch for supporting the motor out of the water. The detent apparatus is designed to facilitate pivotal operation of the block with respect to the clamp upon striking of an underwater obstacle by the motor, in order to move the motor from engagement with the submerged obstacle.

One of the problems which is apparent regarding existing motor brackets, and trolling motor brackets for electric trolling motors in particular, is the lack of protection afforded the submerged motor unit and particularly, the motor shaft, from damage resulting in contact with underwater obstacles. These trolling motors are typically mounted on a folding bracket attached to the bow of a boat, and extend downwardly from the bow into the water. Accordingly, the pressure applied on the submerged motor and the extending shaft by a submerged stump, log or other obstacle as the boat is propelled by the trolling motor is a function of the speed and weight of the boat and occupants. Since many of the larger and heavier fishing boats are provided with powerful, 24-volt trolling motor systems for greater speed and effective operation of the boat in a wind, the momentum generated by the boat frequently causes the trolling motor shaft to bend when the motor or shaft strikes such an obstacle. Consequently, the shaft must either be straightened or replaced, at considerable expense. One effort to deal with this problem is featured in an electric trolling motor bracket developed by Motor-Guide Division of Arnold Industries, Inc., which includes curved and slotted guides supporting pins secured to the motor shaft support bracket and designed to facilitate a 30 degree pivot of the motor and shaft when an underwater obstacle is encountered.

Another problem frequently encountered in the use of conventional electric trolling motors is the mounting of the motor on the boat, which frequently requires that the top segment of the motor and shaft extend inside the hull area when the motor is in retracted configuration. This mounting arrangement requires interior space which could otherwise be used by the fisherman. Since conventional trolling motor mount brackets are rigid with respect to the retracting boat bracket, the boat bracket must be mounted in such a manner as to point the trolling motor generally forward of the bow, and depending upon the design of the boat, there is generally very little flexibility of choice in positioning the bracket on the bow of the boat.

Accordingly, it is an object of this invention to provide a universal trolling motor bracket which is capable of interfacing with substantially any conventional folding boat bracket, which trolling motor bracket is characterized by a "breakaway" function and a pivoting feature for protection of the trolling motor shaft and hinged adjustment of the trolling motor position with respect to the bow of the boat, respectively.

Another object of the invention is to provide a new and improved trolling motor bracket which incorporates a substantially unlimited "breakaway" function to protect the motor shaft from bending or breaking due to contact with underwater obstacles, which breakaway function is always essentially perpendicular to any such load applied to the submerged motor or shaft when the motor is propelling the boat forward.

Yet another object of this invention is to provide a new and improved trolling motor bracket which includes a shaft bracket having a split housing and, in a most preferred embodiment, a sleeve in the housing for adjustably gripping the motor shaft, and further including a rear slot means as one element of the "breakaway" function; a bracket hinge pivotally attached to the shaft bracket and having a pair of pins threadably attached thereto, the pins positioned for contact with the slot means in the shaft bracket and adjusting the friction-operated "breakaway" function of the shaft bracket; and a support bracket attached to the bracket hinge and to a conventional folding boat bracket mounted to the deck of a boat, the bracket hinge serving to permit rotational adjustment of the shaft bracket and the motor shaft with respect to the bow of the boat.

SUMMARY OF THE INVENTION

These and other objects of the invention are provided in a trolling motor bracket having a substantially unlimited, downwardly pivoting, "breakaway" feature to protect the shaft of a trolling motor, and a vertically pivoting and adjusting function to facilitate an optimized mounting of the trolling motor on a boat deck and greater flexibility in operating the trolling motor, which trolling motor bracket is characterized by a shaft bracket having a split housing and in a preferred embodiment, a split shaft insert, which in combination with the shaft bracket is designed to adjustably receive trolling motor shafts of various sizes; a bracket hinge pivotally attached to the bottom downward rotational movement of the shaft bracket and shaft; at least one breakaway pin for engagement with a cooperating slot in the shaft bracket to allow pivoting of the shaft bracket and trolling motor with respect to the bracket hinge when the trolling motor encounters an underwater obstacle; and a support bracket attached to the bracket hinge and mounted on a conventional trolling motor lift bracket attached to the boat.

BRIEF DESCRIPTION OF THE DRAWINGS

The invention will be better understood by reference to the accompanying drawings wherein.

DESCRIPTION OF THE PREFERRED EMBODIMENTS

Figure 1:
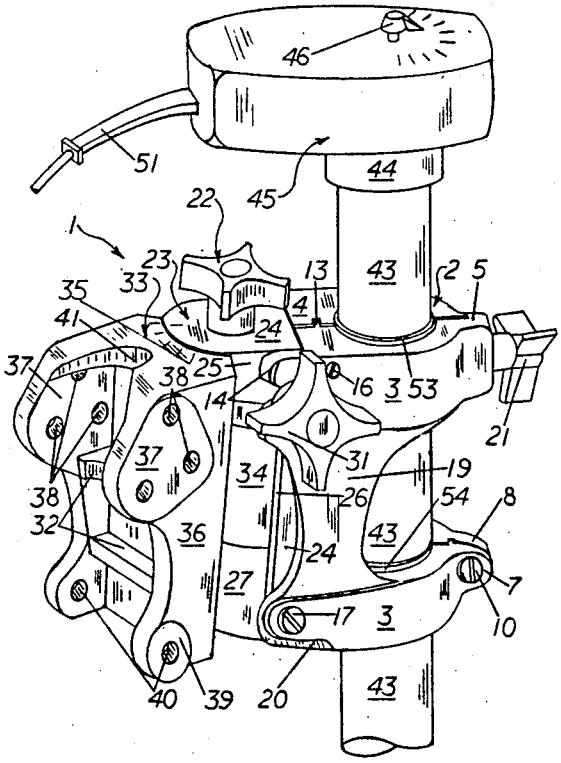
FIG. 1 is a perspective view of the trolling motor bracket of this invention with a trolling motor shaft in functional position in the bracket.
Figure 3:
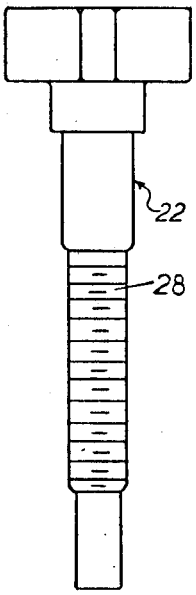
FIG. 3 is an elevation of a preferred bracket hinge pin for use in the trolling motor bracket.
Figure 2:
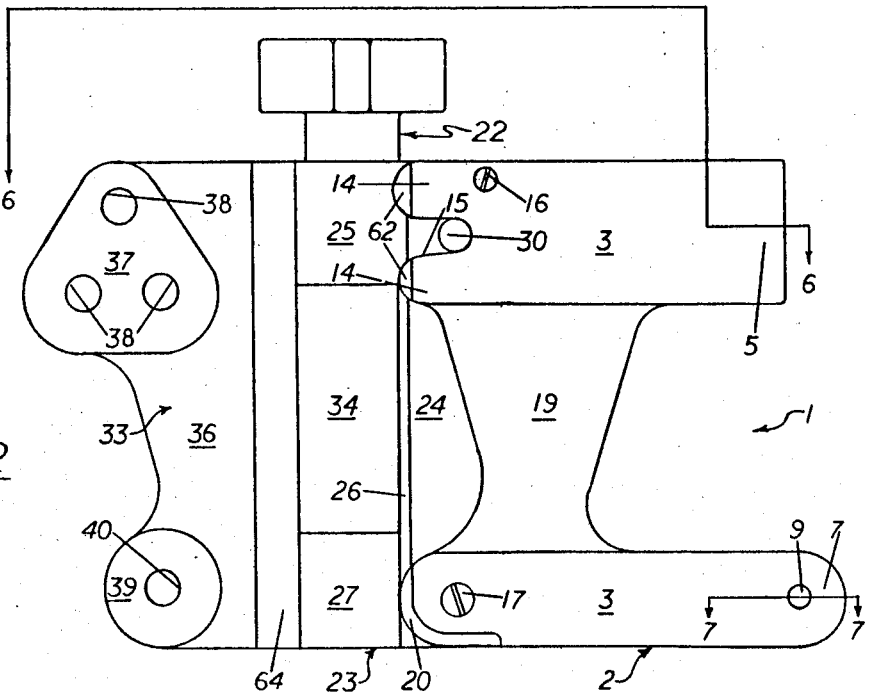
FIG. 2 is a side elevation of the trolling motor bracket illustrated in FIG. 1 with the trolling motor, breakaway pins, shaft tension screw and housing flange bolt removed.

Referring to FIGS. 1–3 of the drawings, in a most preferred embodiment the trolling motor bracket of this invention is generally illustrated by reference numeral 1, and includes a shaft bracket 2, having a right housing 3 and a left housing 4, each with a housing neck 19, which mate to support motor shaft 43 of trolling motor 42. Trolling motor 42 is conventional in design, with a motor unit (not illustrated) mounted on the bottom end of motor shaft 43, a wiring housing 45 secured to the opposite end of the motor shaft 43 by means of a shaft collar 44, and a direction indicator 46 rotatably secured to the top of wiring housing 45. Wiring 51 connects the wiring housing 45 with an appropriate control system (not illustrated). A housing collar 5 projects from the front of shaft bracket 2 and is internally threaded to accommodate a shaft tension screw 21, the function of which is hereinafter described. A housing flange bolt 10 extends through housing flange aperture 9 in the lower extremity of shaft bracket 2, to join right housing 3 and left housing 4, and a pair of shaft bracket pivot bolts 17 are provided in the lower segment of right housing 3 and left housing 4, respectively, in order to pivotally join shaft bracket 2 to bracket hinge plate 24 of bracket hinge 23. A support bracket 33 is pivotally joined to bracket hinge 23 by registration of the bracket pin mount 34, carried by support bracket 33, and the top bracket hinge ring 25 and bottom bracket hinge ring 27, attached to bracket hinge plate 24 in bracket hinge 23. A bracket hinge pin 22, provided with bracket hinge pin threads 28, and more particularly illustrated in FIG. 3, is inserted in a central aperture provided in top bracket hinge ring 25, bracket pin mount 34 and bottom bracket hinge ring 27, and is threadably mated with internal threads provided in the central aperture in bracket pin mount 34, to facilitate tightening or loosening bracket hinge pin 22 and bracket pin mount 34 against top bracket hinge ring 25. In this manner the tension in bracket hinge 23 can be adjusted to permit shaft bracket 2 and trolling motor 42 to rotate with respect to support bracket 33 through an angle of from about 45 to about 60 degrees. Support bracket 33 is provided with rearwardly extending top mount flanges 37, having a plurality of spaced top mount flange apertures 38, for mounting the guide struts of conventional boat bracket mounts to the support bracket 33, as hereinafter described. Similarly, bottom mount flanges 39 are designed to receive a pin for mounting a conventional boat bracket to the support bracket 33. Guide blocks 32, provided between support bracket bodies 36 are designed to receive and brace the guide struts and the bolt bracket, respectively, as further hereinafter set forth. A support bracket groove 41 in support bracket 33 and a matching groove in the top one of guide blocks 32 are designed to accommodate a release cord (not illustrated) for raising and lowering the trolling motor in conventional fashion.

Figure 4:
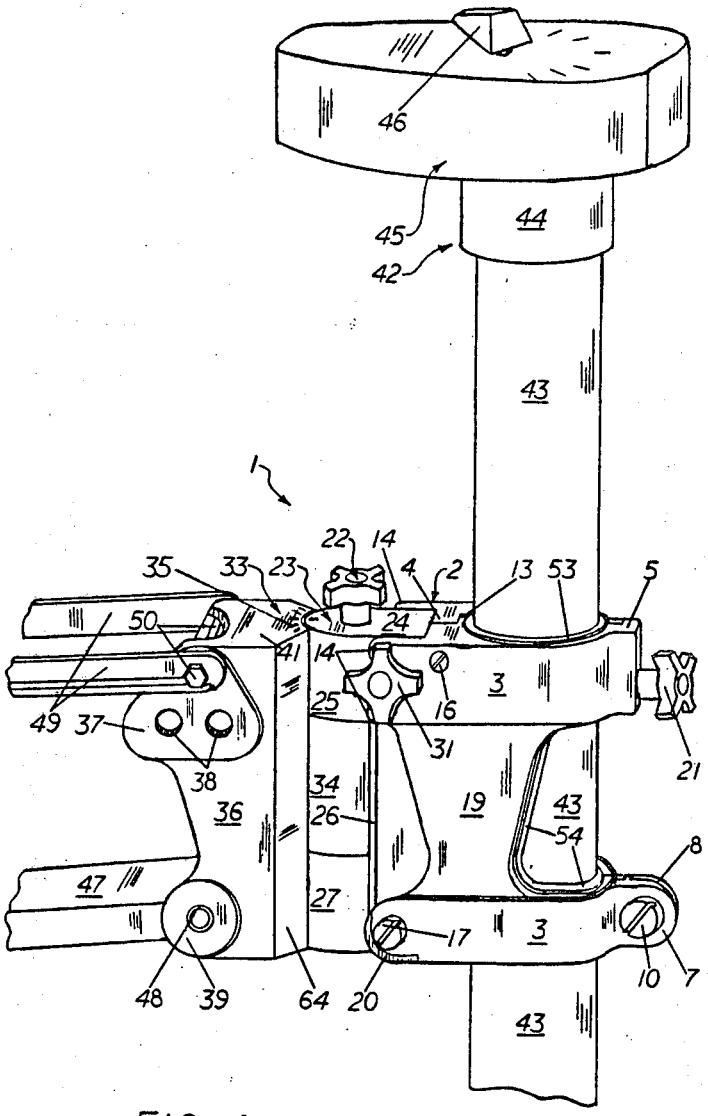
FIG. 4 is a side perspective view of the trolling motor bracket with the trolling motor in functional position and the support bracket segment of the trolling motor bracket secured to mounting elements of a conventional, folding boat bracket.
Figure 5:
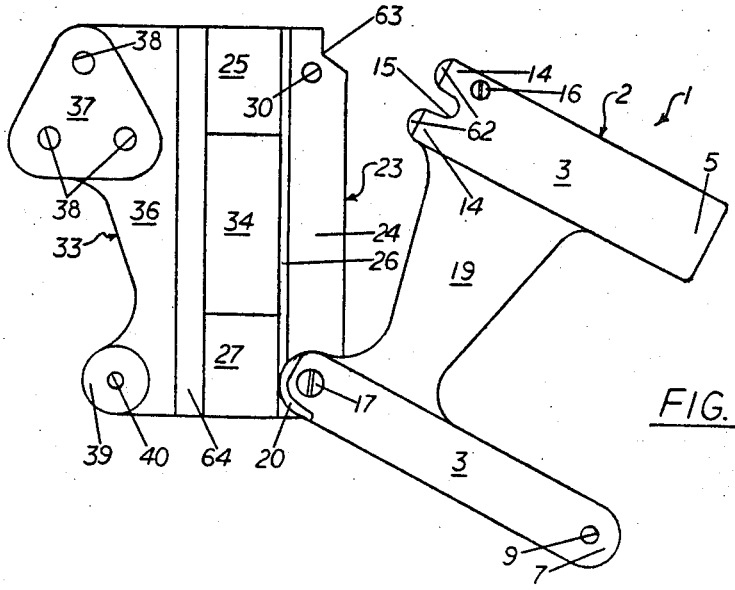
FIG. 5 is a side elevation of the trolling motor bracket illustrated in FIG. 2, more particularly illustrating the breakaway function of the trolling motor bracket.
Figure 6:
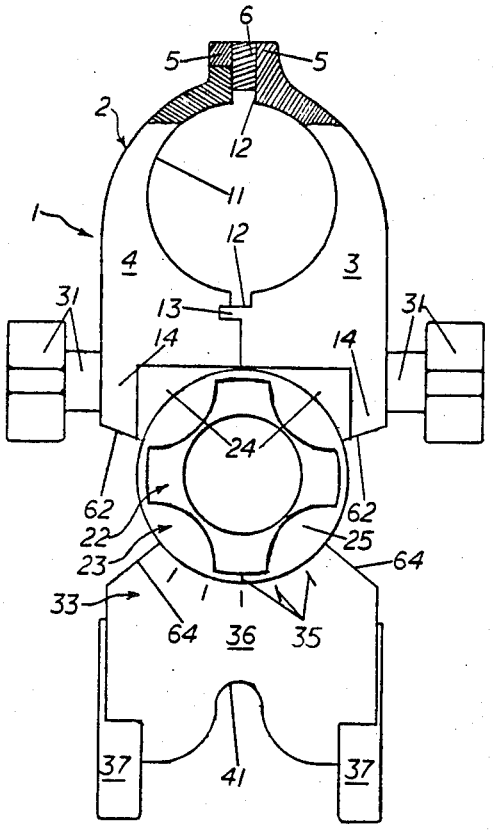
FIG. 6 is a top elevation, partially in section taken along lines 6—6, of the trolling motor bracket illustrated in FIG. 2, with the breakaway pins illustrated in functional position.

Referring now to FIGS. 2 and 4–7 of the drawings, a most preferred embodiment of the invention features the pivoting of shaft bracket 2 with respect to bracket hinge 23 and support bracket 33, in order to protect the motor shaft 43 and motor unit (not illustrated) of the trolling motor 42, when the motor unit or motor shaft 43 contacts a submerged obstacle as the boat is moving forward responsive to operation of the trolling motor 42. Referring specifically to FIGS. 2 and 4–6 of the drawings, a pair of breakaway pins 31 are threadably inserted in threaded breakaway pin apertures 30, provided on each side of bracket hinge plate 24. Breakaway pin slots 15, provided in breakaway flanges 14 of right housing 3 and left housing 4, engage the breakaway pins 31 when shaft bracket 2 is rotated upwardly and rearwardly against bracket hinge plate 24 of bracket hinge 23. Accordingly, it will be appreciated that breakaway pins 31 can be tightened or loosened in breakaway pin apertures 30 to increase or decrease the pressure on breakaway flanges 14 and hence, the pressure required to rotate shaft bracket 2 downwardly on shaft bracket pivot bolt 17. It will be appreciated from a consideration of FIGS. 2, 4 and 5 of the drawings that the groove 20 provided in the lower portion of right housing 3 and left housing 4, is designed to facilitate free and substantially unlimited pivoting of shaft bracket 2 downwardly when shaft bracket 2 is turned at a sharp angle on bracket hinge 23 in close proximity to support bracket body bevels 64 and support bracket body 36. Furthermore, the flange bevels 62 in breakaway flanges 14, the plate bevel 26, in bracket hinge plate 24, and the opposing support bracket body bevel 64 are designed to permit a maximum turning angle of shaft bracket 2 with respect to support bracket 33. The directional markings 35 in top bracket hinge ring 25 serve to identify specific degrees of rotation of shaft bracket 2 with respect to support bracket 33, as illustrated in FIG. 6. As heretofore described, and as illustrated in FIG. 4, top mount flange 37 is provided with spaced top mount flange apertures 38, which accommodate a guide strut pin 50 to pivotally join guide struts 49 to top mount flanges 37. Similarly, a boat bracket pin 48 registers with the bottom mount flange apertures 40 (illustrated in FIG. 5) to pivotally join boat bracket 47 to bottom mount flanges 39.

Figure 7:
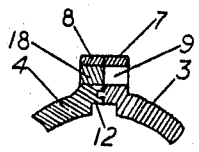
FIG. 7 is a sectional view taken along lines 7—7 in FIG. 2, more particularly illustrating a preferred split housing configuration of the trolling motor bracket.
Figure 8:
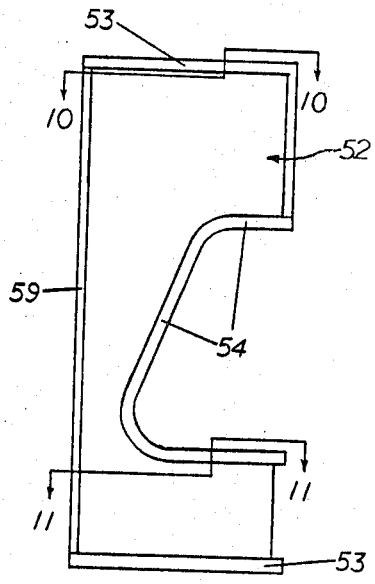
FIG. 8 is a side elevation of a preferred shaft sleeve for insertion in the trolling motor shaft bracket to mount the trolling motor shaft in the bracket.

Referring now specifically to FIGS. 6 and 7 of the drawings, in a preferred embodiment of the invention right housing 3 and left housing 4 of shaft bracket 2 are split in order to facilitate easy insertion of motor shaft 43 in the shaft aperture 11. The housing collar 5 is provided with an aperture having internal housing collar threads 6, as illustrated in FIG. 6, and with shaft aperture notches 12, provided in housing collar 5 and located in oppositely-disposed relationship across shaft aperture 11. The rear one of shaft aperture notches 12 is defined by a right housing key 13, projecting from right housing 3 into left housing 4, as illustrated. As further illustrated in FIG. 7, a right housing flange 7 projects forwardly from the lower extremity of right housing 3, and a corresponding left housing flange 8 projects in parallel relationship to right housing flange 7, from the left housing 4. Left housing flange threads 18 are provided in an aperture in left housing flange 8, which aperture is in registration with a corresponding housing flange aperture 9 in right housing flange 7. Right housing flange 7 is secured to left housing flange 8 by means of the housing flange bolt 10, illustrated in FIGS. 1 and 4. In addition to housing flange bolt 10, a shaft bracket pin 16 extends through an aperture in right housing 3, and threadably engages a second aperture provided in left housing 4, to aid in securing right housing 3 to left housing 4.

Figure 9:
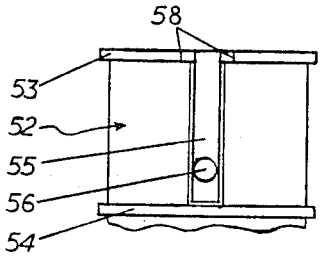
FIG. 9 is a front elevation, partially in section, of the trolling motor shaft sleeve, more particularly illustrating a preferred shaft sleeve tab for securing a trolling motor at a selected elevation in the trolling motor bracket.
Figure 10:
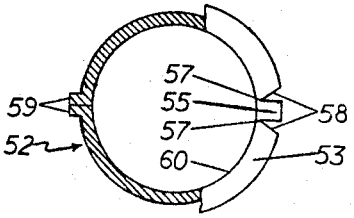
FIG. 10 is a top elevation, partially in section taken along lines 10—10 in FIG. 8, illustrating a preferred configuration of the shaft sleeve.
Figure 11:
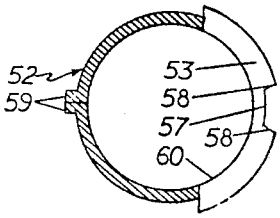
FIG. 11 is another sectional view of the shaft sleeve, taken along lines 11—11 in FIG. 8.

Referring now to FIGS. 8–11 of the drawings, in a most preferred embodiment of the invention, the trolling mount motor bracket 1 is provided with a shaft sleeve 52, having a pair of shaft sleeve collars 53 at the top and bottom thereof, a shaft sleeve bore 60 and a shaft sleeve inset 54, which is shaped in the configuration of the shaft bracket neck 19, of shaft bracket 2. Accordingly, it will be appreciated that shaft sleeve 52 fits inside the shaft aperture 11 defined by right housing 3 and left housing 4 of shaft bracket 2. In another most preferred embodiment of the invention, the rear portion of shaft sleeve 52 is provided with longitudinal shaft sleeve flanges 59, which lie adjacent each other in facing relationship, and oppositely-disposed hinge slots 58, provided in the top one of shaft collars 53, to permit shaft sleeve 52 to be opened and slipped around a motor shaft 43 prior to insertion of the shaft sleeve 52 and the motor shaft 43 in shaft aperture 11 of shaft bracket 2, as hereinafter described. Shaft sleeve 52 is also provided with a shaft sleeve tab 55, which is also positioned in oppositely disposed relationship from shaft sleeve flanges 59 between hinge slots 58, and shaft sleeve flanges 59 register with the rear one of shaft aperture notches 12. The hinge slots 58 continue in the bottom segment of shaft sleeve 52, as illustrated in FIG. 11. Shaft sleeve tab 55 in turn registers with the forward one of shaft aperture notches 12 provided in shaft bracket 2, when shaft sleeve 52 is inserted in shaft aperture 11. In yet another most preferred embodiment of the invention, shaft sleeve tab 55 is hinged at tab hinges 57 located at the base of hinge slots 58 in the top one of shaft sleeve collars 53, and is in alignment with the aperture in housing collar 5, as sleeve tab 55 extends downwardly through the front one of shaft aperture notches 12. This permits the shaft sleeve tab 55 to be forced against the motor shaft 43 by tightening shaft tension screw 21 in housing collar threads 6, to adjustably secure motor shaft 43 at a desired height in shaft bracket 2, as hereinafter described. As illustrated in FIG. 9 of the drawings, a tab bearing surface 56 indicates the point at which shaft tension screw 21 contacts shaft sleeve tab 55.

In operation, and referring again to the drawings, the trolling motor bracket 1 of this invention is used as follows. The shaft bracket 2 of trolling motor bracket 1 is initially removed from bracket hinge 23 by loosening breakaway pins 31 and removing the shaft bracket pivot bolts 17 from engagement with right housing 3 and left housing 4 and bracket hinge plate 24. The right housing 3 and left housing 4 are then separated after removing shaft bracket pin 16 and housing flange bolt 10. In a preferred embodiment of the invention where a shaft sleeve 52 is utilized in the trolling motor bracket 1, a shaft sleeve 52 of appropriate size is then opened at shaft sleeve flanges 59 and fitted around the motor shaft 43 of the trolling motor 42, with the motor shaft 43 positioned inside the shaft sleeve bore 60. Right housing 3 and left housing 4 are then matched around shaft sleeve 52 such that shaft sleeve 52 is located in shaft aperture 11 defined by right housing 3 and left housing 4, with the shaft sleeve tab 55 aligned with the front one of shaft aperture notches 12, and the shaft sleeve flanges 59 in registration with the rear one of shaft aperture notches 12, to prevent shaft sleeve 52 from rotating in shaft aperture 11.

Shaft bracket pin 16 is then reinserted through the upper portion of right housing 3 and tightened in the threaded cooperating upper portion of left housing 4, and the shaft bracket pivot bolts 17 are inserted through the pivot bolt apertures in right housing 3 and left housing 4 and threadably tightened in a theaded aperture in bracket hinge plate 24. In a most preferred embodiment of the invention shaft bracket pivot bolts 17 are shoulder bolts which facilitates tightening in bracket hinge plate 24 without providing undue friction on the lower segment of right housing 3 and left housing 4 to allow shaft bracket 2 to readily pivot on the shaft pivot bolts 17. The housing flange bolt 10 is then inserted in housing flange aperture 9 and tightened in left housing flange threads 18, and shaft tension screw 21 is inserted in the aperture provided in housing collar 5 and tightened in housing collar threads 6, to force the shaft sleeve tab 55 against motor shaft 43 and secure the trolling motor 42 in a selected position in trolling motor bracket 1. The trolling motor bracket 1 is now in functional position and is ready to be mounted on a conventional boat bracket.

Referring now to FIGS. 1 and 4 of the drawings, depending upon the specific design of the folding boat bracket to which the trolling motor bracket 1 is to be mounted, the boat bracket 47 is inserted in support bracket body 36 adjacent the lower one of guide blocks 32, and a boat bracket pin 48 is inserted through bottom mount flange apertures 40 in bottom mount flanges 39, and then through an aperture in the end of bolt bracket 47, to pivotally secure bolt bracket 47 to support bracket 33. Similarly, the conventional guide struts 49 of the folding boat bracket are placed in registration with the appropriate and corresponding one of top mount flange apertures 38 in top mount flanges 37, and a guide strut pin 50 is inserted through apertures in guide struts 49 which register with the appropriate top mount flange apertures 38, to pivotally secure guide struts 49 to support bracket 33. Accordingly, when the folding boat bracket is secured to the deck of a boat, the trolling motor bracket 1 and trolling motor 42 can be raised and lowered in conventional fashion by operating the conventional boat bracket 47 and guide struts 49 according to the knowledge of those skilled in the art, to place the trolling motor 42 in functional position for trolling, as illustrated in FIG. 4, or to position the trolling motor 42 on the deck of a boat in retracted configuration. It will be appreciated that the ends of the boat bracket pin 48 are flush with the surfaces of bottom mount flanges 39, and the guide strut pin 50 can be fitted with a cooperating nut or a retaining pin (not illustrated) to retain the guide strut pin 50 in functional position.

It will be further appreciated by those skilled in the art that a primary feature of the trolling motor bracket 1 of this invention is the breakaway function which permits the motor unit to pivot rearwardly upon striking an underwater obstacle in order to prevent damage to the submerged motor or to the motor shaft 43. Accordingly, referring again to FIGS. 4 and 5 of the drawings, it will be appreciated that breakaway pins 31 can be tensioned to a desired degree against breakaway flanges 14 when the breakaway pin slots 15 are in registration with the breakaway pins 31, to adjust the force required to pivot the breakaway flanges away from breakaway pins 31 when the submerged motor and the submerged portion of motor shaft 43 are forced rearwardly. Another primary feature of the invention is the rotation of shift bracket 2 and motor shaft 43 on bracket hinge 23 with respect to support bracket 33 and the boat itself. This versatility permits trolling motor 42 to be positioned in any forward direction within an angle of from about 45 to about 60 degrees with respect to the boat, as heretofore described, and when placed in any such angular position, the shaft bracket 2 can be immobilized on bracket hinge 23 by tightening bracket hinge pin 22 to maintain the desired position. Furthermore, depending upon the depth of the water, the trolling motor 42 can be raised or lowered in shaft bracket 2 by loosening shaft tension screw 21 and adjusting motor shaft 43 in shaft sleeve 52 with respect to right housing 3 and left housing 4, as desired. Yet another versatile feature of the trolling motor bracket 1 of this invention is the universal nature of the bracket, which allows it to be mounted on substantially any existing, commercially available folding boat bracket. Referring again to FIGS. 1 and 4, the top mount flange apertures 38 provided in support bracket body 36 are spaced in such a manner as to accommodate substantially any conventional guide struts 49, and it has been found that a single position of any of the commercially available boat brackets 47 in support bracket body 36 is expedient to pivotally secure the boat brackets 47 to the support bracket 33. Accordingly, a single bottom mount flange aperture 40 is provided in each of the bottom mount flanges 39 to accommodate the selected boat bracket 47. Consequently, the trolling motor bracket of this invention can be quickly and easily adapted to substantially any existing folding boat mount bracket with minimum effort, and used to facilitate both safety of the motor and the motor shaft during trolling. Furthermore, referring again to the drawings, a motor shaft 43 of substantially any commercially available diameter can be used in the trolling motor bracket 1 by supplying a shaft sleeve 52 of appropriate size to snugly fit on the motor shaft 43. Accordingly, if the shaft sleeve 52 and the motor shaft 43 are smaller than the shaft aperture 11 in shaft bracket 2, motor shaft 43 can still be easily clamped in shaft bracket 2 by tightening shaft tension screw 21 against shaft sleeve tab 55, which projects shaft sleeve tab 55 into shaft aperture 11 tightly against the motor shaft 43. This feature has the added advantage of eliminating scarring of the motor shaft 43 by avoiding contact between the motor shaft 43 and the shaft tension screw 21, since the shaft tension screw 21 presses the shaft sleeve tab 55 against the motor shaft 43 to provide the necessary tension to secure the motor shaft 43 inside the shaft sleeve 52 and shaft bracket 2.

Other advantages of the trolling motor bracket of this invention will be apparent to those skilled in the art, and while the preferred embodiments of the invention have been described above, it will be recognized and understood that various modifications can be made therein, and the appended claims are intended to cover all such modifications which may fall within the spirit and the scope of the invention.

Having described my invention with the particularity set forth above, what is claimed is:

1. A trolling motor bracket for supporting the shaft of a trolling motor comprising:

(a) a shaft bracket having a first shaped housing member; a second shaped housing member cooperating with said first shaped housing member; a shaft aperture defined by said first shaped housing member and said second shaped housing member for receiving the shaft of the trolling motor; and rearwardly facing slots in said first shaped housing member and said second shaped housing member;

(b) a bracket hinge pivotally attached to said shaft bracket;

(c) a support bracket hingedly attached to said bracket hinge and top mount flanges provided in said support bracket for attachment to the guide struts of a folding boat bracket and bottom mount flanges provided in said support bracket for attachment to the boat bracket member in the folding boat bracket; and (d) bracket hinge pin means cooperating with said bracket hinge and said support bracket to permit said shaft bracket to hingedly rotate horizontally on said bracket hinge with respect to said support bracket, said bracket hinge pin means further characterized by a threaded, elongated bracket hinge pin in threadable cooperation with said support bracket for adjusting the hinge tension between said bracket hinge and said support bracket;

(e) two threaded, elongated breakaway pins in threadable cooperation with both sides of said bracket hinge and arranged in essentially oppositely disposed relationship, said breakaway pins normally registering with said rearwardly facing slots in said first shaped housing member and said second shaped housing member, respectively, when the trolling motor is in normal operating configuration; and (f) a threaded, elongated shaft tension screw in threadable cooperation with said shaft bracket for selectively exerting pressure against the shaft of the trolling motor and biasing the shaft of the trolling motor at a selected height in said shaft bracket.

2. A trolling motor bracket for supporting the shaft of a trolling motor comprising;

(a) a shaft bracket having a first shaped housing member; a second shaped housing member cooperating with said first shaped housing member; a shaft aperture defined by said first shaped housing member and said second shaped housing member for receiving the shaft of the trolling motor; and rearwardly facing slots in said first shaped housing member and said second shaped housing member;

(b) a bracket hinge pivotally attached to said shaft bracket;

(c) a support bracket hingedly attached to said bracket hinge and top mount flange provided in said support bracket for attachment to the guide struts of a folding boat bracket and bottom mount flanges provided in said support bracket for attachment to the boat bracket member in the folding boat bracket;

(d) at least one breakaway pin means cooperating with said bracket hinge and positioned in registration with said rearwardly facing slots in at least one of said first shaped housing member and said second shaped housing member to releasably secure said rearwardly facing slots in registration with said breakaway pin means when the trolling motor is in normal operating configuration; and (e) shaft tension screw means threadably cooperating with said shaft bracket and biasing the shaft of the trolling motor at a selected height in said shaft bracket; and (f) a shaft sleeve and a shaft sleeve tab hingedly carried by said shaft sleeve and extending downwardly from the front of said shaft sleeve, said shaft sleeve adapted for insertion in said shaft aperture of said shaft bracket with said shaft sleeve tab in alignment with said shaft tension screw means, whereby said shaft tension screw means can be threadably advanced in said shaft bracket against said shaft sleeve tab to press said shaft sleeve tab against the shaft of the trolling motor and secure the trolling motor in said shaft bracket at a selected height.

3. A trolling motor bracket for supporting the shaft of a trolling motor comprising;

(a) a shaft bracket having a first shaped housing member; a second shaped housing member cooperating with said first shaped housing member; a shaft aperture defined by said first shaped housing member and said second shaped housing member for receiving the shaft of the trolling motor; and rearwardly facing slots in said first shaped housing member and said second shaped housing member;

(b) a bracket hinge pivotally attached to said shaft bracket;

(c) a support bracket hingedly attached to said bracket hinge and top mount flanges provided in said support bracket for attachment to the guide struts of a folding boat bracket and bottom mount flanges provided in said support bracket for attachment to the boat bracket member in the folding boat bracket;

(d) bracket hinge pin means cooperating with said bracket hinge and said support bracket to permit said shaft bracket to hingedly rotate horizontally on said bracket hinge with respect to said support bracket, said bracket hinge pin means further characterized by a threaded, elongated bracket hinge pin in threadable cooperation with said support bracket for adjusting the hinge tension between said bracket hinge and said support bracket;

(e) two threaded, elongated breakway pins in threadable cooperation with both sides of bracket hinge and arranged in essentially oppositely disposed relationship, said breakaway pins normally registering with said rearwardly facing slots in said first shaped housing member and said second shaped housing member, respectively, when the trolling motor is in normal operating configuration;

(f) a theaded, elongated shaft tension screw in threadable cooperation with said shaft bracket for selectively exerting pressure against the shaft of the trolling motor; and (g) a shaft sleeve and a shaft sleeve tab hingedly carried by said shaft sleeve and extending downwardly from the front of said shaft sleeve, said shaft sleeve adapted for insertion in said shaft aperture of said shaft bracket with said shaft sleeve tab in alignment with said shaft tension screw means, whereby said shaft tension screw means can be threadably advanced in said shaft bracket against said shaft sleeve tab to press said shaft sleeve tab against the shaft of the trolling motor and secure the trolling motor in said shaft bracket at a selected height.

4. The trolling motor bracket of claim 3 wherein said shaft aperture of said shaft bracket further comprises a front notch and a rear notch essentially oppositely disposed across said shaft aperture from said front notch, and further comprising flanges in said shaft sleeve for registration with said rear notch in said shaft bracket, said shaft sleeve tab positioned in registration with said front notch, to prevent said shaft sleeve from rotating in said shaft aperture.

5. The trolling motor bracket of claim 4 further comprising a pair of pivot bolts threadably carried by said bracket hinge in oppositely-disposed relationship and cooperating with said first shaped housing member and said second shaped housing member to thereby pivotally secure said shaft bracket to said bracket hinge.

* * * * *